United States Patent [19]

Jennings

[11] 3,979,706

[45] Sept. 7, 1976

[54] SHIELDED INDUCTANCE COIL WITH TRIMMER

[75] Inventor: Thomas A. Jennings, Glenside, Pa.

[73] Assignee: Hull Corporation, Hatboro, Pa.

[22] Filed: June 26, 1975

[21] Appl. No.: 590,621

Related U.S. Application Data

[63] Continuation of Ser. No. 434,905, Jan. 21, 1974, abandoned.

[52] U.S. Cl. ..... 336/83; 336/81; 336/134; 336/136; 336/200

[51] Int. Cl.[2] ..... H01F 21/06

[58] Field of Search ..... 336/83, 84, 87, 132, 336/133, 134, 130, 136, 200

[56] References Cited

UNITED STATES PATENTS

| | | | |
|---|---|---|---|
| 1,699,506 | 1/1929 | Faus | 336/134 |
| 2,419,697 | 4/1947 | Wolff | 336/134 |
| 2,513,160 | 6/1950 | Friend | 336/134 X |
| 2,664,795 | 1/1954 | Tone | 336/134 X |
| 2,946,029 | 7/1960 | Abrams et al. | 336/83 X |
| 3,209,294 | 9/1965 | Cornell | 336/134 |

FOREIGN PATENTS OR APPLICATIONS

| | | | |
|---|---|---|---|
| 260,478 | 3/1964 | Australia | 336/83 |
| 924,139 | 7/1947 | France | 336/132 |
| 1,234,315 | 2/1967 | Germany | 336/83 |
| 449,763 | 6/1936 | United Kingdom | 336/132 |
| 1,180,923 | 2/1970 | United Kingdom | 336/83 |

*Primary Examiner*—Thomas J. Kozma
*Attorney, Agent, or Firm*—Oliver D. Olson

[57] ABSTRACT

An electrical inductance coil, having a central opening therethrough, is surrounded by a spaced shield of magnetic metal, and a screw of magnetic metal is mounted in engagement with one side of the shield for adjustable extension through the central opening in the coil for varying the spacing between the inner end of the screw and the confronting, opposite side of the shield.

2 Claims, 7 Drawing Figures

SHIELDED INDUCTANCE COIL WITH TRIMMER

This is a continuation of application Ser. No. 434,905, filed Jan. 21, 1974 and now abandoned.

BACKGROUND OF THE INVENTION

This invention relates to electrical inductance coils, and more particularly to a shielded inductance coil capable of being trimmed to predetermined diverse specifications.

The fabrication of electronic circuits, and especially microcircuits, requires the combination of a number of discreet electrical components each of which must meet a specified set of tolerances in order to bring the circuit to within specified limits of design characteristics. This can be achieved in some instances by carefully measuring and evaluating each component to provide matched circuit elements. This procedure is time consuming and costly. In other instances even this procedure is ineffective because of the unpredictability of the effects of leads and contacts on circuit characteristics.

In the use of inductance coils, which depend for their performance on the formation of a magnetic field, it is often necessary to shield them from extraneous magnetic fields and also to shield other circuit components from the stray magnetic fields of the coils, while still affording adjustment of the inductance and inductive reactance of the coils.

The procedure generally employed in adjusting the inductance and inductive reactance of a coil involves the shorting of some of the turns. However, this procedure only provides a coil of a predetermined, fixed inductance and inductive reactance, and can only result in a decrease in the inductance and inductive reactance of the original coil.

Shielding of inductance coils, by enclosing them in containers of magnetic metal, is well known, and is utilized in conjunction with the foregoing adjustment procedure to provide shielded coils having a predetermined, fixed inductance.

However, the provision of a shielded coil capable of variable adjustment, heretofore has been applicable only to standard sizes of radio frequency coils, and has involved complex construction which renders difficult any subsequent readjustment of the inductance.

SUMMARY OF THE INVENTION

In its basic concept, this invention involves the enclosure of an inductance coil with a shield of magnetic metal one side of which mounts a rod of magnetic metal for adjustment of its inner end through the central opening in the coil to variable distances from the opposite side of the shield.

It is by virtue of the foregoing basic concept that the principal objective of this invention is achieved; namely, to overcome the aforementioned limitations and disadvantages of prior inductance coil constructions.

Another important object of this invention is the provision of a shielded inductance coil with trimmer capable of being provided in microminiature sizes for use in microcircuit technology.

A further important object of this invention is the provision of a shielded inductance coil with trimmer, in the form of a transformer.

The foregoing and other objects and advantages of this invention will appear from the following detailed description, taken in connection with the accompanying drawing which illustrates preferred embodiments.

DESCRIPTION OF THE PREFERRED EMBODIMENTS

Figure 1:
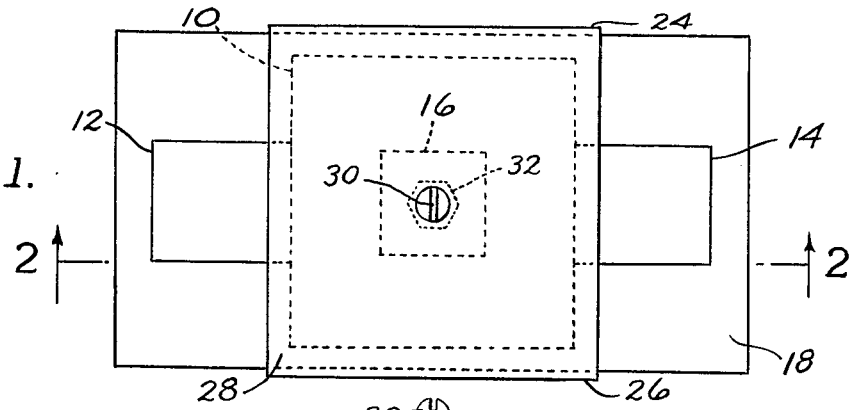
FIG. 1 is a plan view of a shielded inductance coil with trimmer embodying the features of this invention.
Figure 2:
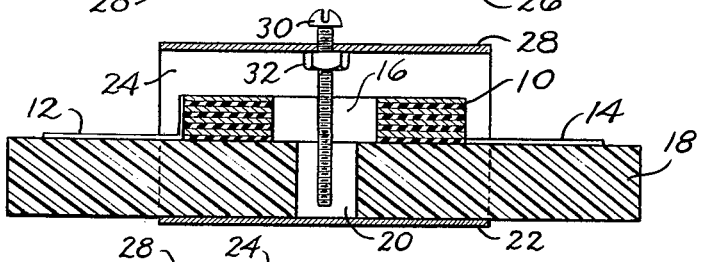
FIG. 2 is a sectional view taken on the line 2—2 in FIG. 1.
Figure 3:
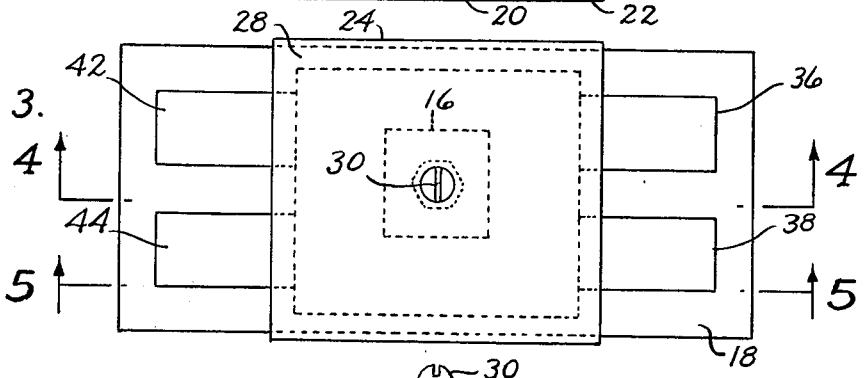
FIG. 3 is a plan view of a shielded transformer with trimmer, embodying the features of this invention.
Figure 4:
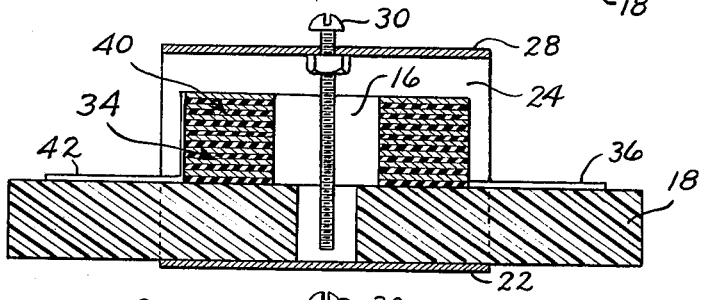
FIG. 4 is a sectional view taken on the line 4—4 in FIG. 3.
Figure 5:
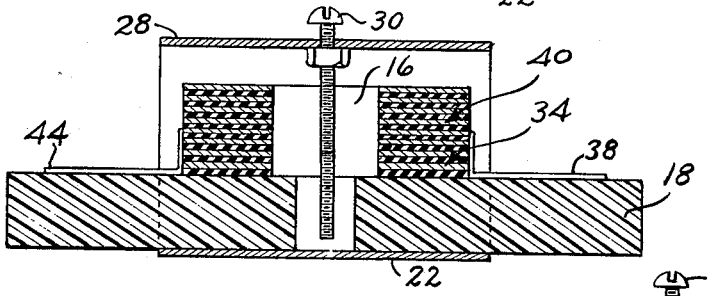
FIG. 5 is a sectional view taken on the line 5—5 in FIG. 3.
Figure 6:
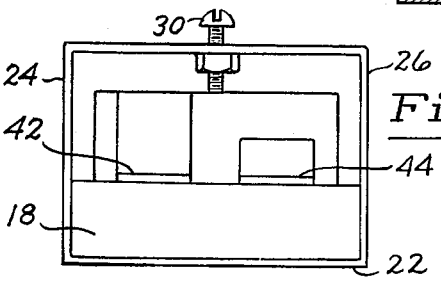
FIG. 6 is an end elevation as viewed from the left in FIG. 3.
Figure 7:
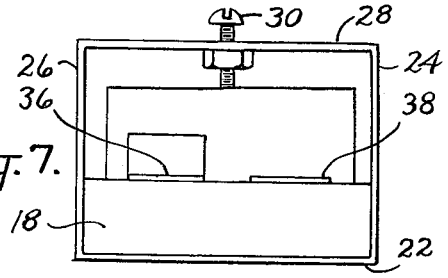
FIG. 7 is an end elevation as viewed from the right in FIG. 3.

Referring first to the embodiment illustrated in FIGS. 1 and 2 of the drawing, there is shown an electrical inductance coil 10 which comprises a plurality of interconnected, overlapping coaxial turns of electrically conductive material, the turns being separated from each other by interposed films of dielectric material. Electrical terminals 12 and 14 extend laterally from the opposite end turns of the coil, and a central opening 16 is provided through the coil.

The overlapping, coaxial coil turns may be provided in a variety of forms, such as a continuous spiral winding of insulated wire; as thick films formed of metal stampings, with the dielectric material provided by preformed sheets; or as thin films formed by conventional printed circuit techniques. However, when the inductance coil is to be provided in microminiature size, it preferably is formed by the vapor depositions of electrically conductive materials and dielectric materials in the manner described in my copending application Ser. No. 17,157, filed Mar. 6, 1970 now U.S. Pat. No. 3,785,046. For this procedure the depositions are made upon a structural substrate 18 of dielectric material, and for the purpose of this invention the substrate is provided with an opening 20 registering with the central opening 16 of the coil.

In accordance with this invention, the coil is shielded by an enclosure of magnetic metal which is spaced from the coil. In the embodiment illustrated, the shield has a bottom side 22 which underlies and is secured to the bottom side of the substrate 18. The shield also includes spaced ends 24 and 26 which extend upward from the bottom side 22 to interconnect the latter with a top side 28 which overlies the coil in spaced relation thereto.

The inductance coil of this invention also includes means for variably trimming the inductance and inductive reactance to predetermined diverse values. For this purpose a rod of magnetic metal is mounted in engagement with one side of the shield for movement through the central opening 18 in the coil for varying the spacing between the inner end of the rod and the confronting, opposite side of the shield. In the specific embodiment illustrated, the rod is in the form of a screw 30 the threaded shank of which engages an internally threaded nut 32 secured to the top side 28 of the shield. The screw thus is adjustable longitudinally through the central openings in the coil and substrate, to vary the spacing between the inner end of the screw and the confronting, bottom side 22 of the shield.

The screw preferably is of sufficient length that its inner end may be brought into contact with the bottom side 22 of the shield. This provides maximum magnetic and electrostatic shielding of the coil.

As the screw is disengaged from the bottom side 22 of the shield and is adjusted outwardly therefrom, the inductance and inductive reactance of the coil is decreased progressively as the spacing increases between the inner end of the screw and the bottom side of the shield. Conversely, the inductance and inductive reactance of the coil may be increased by decreasing the spacing between the inner end of the screw and the bottom side of the shield.

It will be understood that this adjustment of inductance and inductive reactance of the coil, by adjustment of the screw 30, is accommodated while providing significant electrostatic shielding of the coil.

FIG. 3–7 of the drawing illustrate an adjustable transformer. The primary winding 34 of the transformer is shown deposited first upon the substrate 18 with its electrical terminals 36 and 38 extended laterally from the same side of the coil. The secondary winding 40 then is deposited over the primary winding and its electrical terminals 42 and 44 extended to the side of the coil opposite the primary terminals. It will be understood, of course, that the terminals of the primary and secondary windings may be extended from opposite sides of the associated coils, in the manner illustrated in FIG. 1.

As in the first embodiment described, the assembly of primary and secondary windings are enclosed in a shield of magnetic metal, and a screw 30 of magnetic metal engages the top side 28 of the shield and extends adjustably through the central opening 16 in the coil assembly, for varying the spacing between the inner end of the screw and the bottom side 22 of the shield.

From the foregoing it will be appreciated that the present invention provides a shielded and adjustable inductance coil of simplified construction for economical manufacture, which may be provided in a variety of sizes, shapes and coil characteristics, including those microminiature size and which may include transformer configurations; and which provides simplified trimming means which affords readjustment of inductance and inductive reactance with speed and facility.

It will be apparent to those skilled in the art that various changes may be made in the size, shape, type, number and arrangement of parts described hereinbefore, without departing from the spirit of this invention.

Having now described my invention and the manner in which it may be used, I claim:

1. A shielded and trimmable microelectronic inductance coil, comprising:

a. a substrate of dielectric material having an opening therethrough, b. a plurality of overlapping coaxial turns of electrically conductive metal films, the turns being separated electrically from each other by interposed films of dielectric material, the metal and dielectric films being bonded together as an integrated, one-piece unit forming an inductance coil having a central opening therethrough, c. the coil being mounted on one surface of the substrate with said openings in axial alignment, d. a pair of electric terminals extending laterally from the ends of the metal film of the coil and supported on said one surface of the substrate, e. a shield of magnetic metal secured to the substrate and extending in a loop around the substrate and coil in spaced relation to the latter for shielding the coil from extraneous magnetic fields and for shielding other circuit components from stray magnetic fields of the coil, and f. a rod of magnetic metal mounted in engagement with the side of the shield overlying the coil opposite the substrate for movement through the aligned openings in the coil and substrate, for varying the spacing between the inner end of the rod and the confronting opposite side of the shield exposed through the opening in the substrate.

2. The electrical inductor of claim 1 wherein the plurality of coaxial turns of electrically conductive material form a primary winding and at least one secondary winding of a transformer.

* * * * *